United States Patent [19]

Hughes et al.

[11] 4,167,398

[45] Sep. 11, 1979

[54] CARBONACEOUS BRIQUETTE AND METHOD FOR MAKING SAME

[75] Inventors: John Hughes, Arlington Heights; Peter L. Maul, Addison, both of Ill.

[73] Assignee: American Colloid Company, Skokie, Ill.

[21] Appl. No.: 885,661

[22] Filed: Mar. 13, 1978

[51] Int. Cl.[2] ..... C10L 5/02

[52] U.S. Cl. ..... 44/17; 44/16 A; 44/21

[58] Field of Search ..... 44/17, 21, 25, 16 A

[56] References Cited

U.S. PATENT DOCUMENTS

| | | | |
|---|---|---|---|
| 1,590,706 | 6/1926 | Spencer | 44/16 R |
| 1,618,029 | 2/1927 | Wagel | 44/16 B |
| 2,890,945 | 6/1959 | Dohmen | 44/25 |
| 3,068,080 | 12/1962 | Ronzio | 44/17 |
| 3,402,033 | 9/1968 | Starr | 44/17 |
| 3,485,599 | 12/1969 | Richardson et al. | 44/17 |
| 3,836,343 | 9/1974 | Romey et al. | 44/25 |

*Primary Examiner*—Carl Dees

*Attorney, Agent, or Firm*—Poms, Smith, Lande & Rose

[57] ABSTRACT

A combustible carbonaceous briquette, having a high bond strength and good burning characteristics is formed by adding to the carbonaceous material a composition containing from about 80% to 99.9%, by weight, of sodium bentonite, from about 0.1% to 5%, by weight, of a water soluble acid polymer (i.e. having a carboxylic acid, salt thereof or anhydride thereof) and preferably from about 0.1% to 5%, by weight, of a water soluble dispersing agent. A combustible carbonaceous briquette formed from about 90% to 99% of carbonaceous material and a binding effective amount of the binding agent composition to form a briquette which has high strength, will not easily crumble or disintegrate and has good burning characteristics.

8 Claims, No Drawings

CARBONACEOUS BRIQUETTE AND METHOD FOR MAKING SAME

BACKGROUND OF THE DISCLOSURE

Combustible carbonaceous material, in the form of briquettes, is the fuel of choice for cooking various kinds of meat. Cooking meat in this manner is generally referred to as barbecuing. In the process of barbecuing, meat is placed over a source of heat and the meat is cooked in such a manner that various smoke and vapors contact the meat thereby giving the meat its unique barbecue flavor. The smoke and vapors are often times produced by the fats of the meat or barbecue sauce, which when the fat or sauce contact the source of heat they are vaporized and contact the meat to produce the pleasant taste. In addition, sometimes the source of the heat itself may produce a smoke which flavors the meat being cooked. Combustible carbonaceous material, such as charcoal, peat, coal, etc., which has been compressed into the form of a briquette and has sufficient strength to maintain its briquette shape is normally used to barbecue meat.

As is known in the art, charcoal is produced by the destructive distillation or limited combustion (i.e. in the absence of oxygen) of wood, lignites, coal and other petroleum derivatives. The charcoal thus produced is then compressed into briquettes for use as a barbecue fuel. However, other combustible carbonaceous material such as raw coal and peat have also been compressed, formed into briquettes and used as barbecue fuel.

In general, barbecue briquettes are made by adding a binder, such as starch, to, e.g. charcoal, and, perhaps an oxidizing agent, as well as water, and the mixture is compressed and formed into briquettes on a briquetting machine, consisting of two rolls, each with an impression of half of the briquette on the roll, so that when the two rolls are brought together under pressure the material contained therein is squeezed into the pockets to form the familiar briquette-like shape (i.e. a shape similar to a small brick). In general, if charcoal is used, it will have approximately 20% and 30% water and from 8% to 10% of a bonding agent such as starch. After this mixture is formed into the familiar briquette shape, the briquettes are subsequently dried to remove essentially all of the moisture (perhaps the final product will contain no more than 4% moisture) and are then ready for consumer use as a barbecue fuel.

One of the early patents issued relating to the charcoal briquette field is U.S. Pat. No. 1,590,706 which discusses prior art bonding agents for charcoal which, according to the patent, include pitch, chalk, clay, cement, and plaster of paris. The improvement disclosed in this patent is a new bonding agent which is added to finely divided particles of coal to form a briquette possessing the desired properties. According to column 2 of this patent, the patentee uses a "crude soluble phosphate extract obtained by treating phosphatic rock or similar phosphate material with sulphuric acid".

Another early patent is U.S. Pat. No. 1,618,029 which uses a rather wide variety of various bonding agents for coal. The binding agents "stabilized" by the addition of an acid such as sulphuric acid. Another patent which discloses using an acid in conjunction with a binding agent (in this instance starch) is U.S. Pat. No. 2,890,945 which discloses that the addition of acetic acid, to starch and charcoal, is useful in forming a coal briquette.

A more recent innovation in briquettes is disclosed in U.S. Pat. No. 3,485,599 in which certain types of oxidizing agents are added to the charcoal briquette in order to render the briquette rapidly ignitable. In addition to the addition of an oxidizing agent such as sodium nitrate, a retarder is also added to prevent the charcoal briquettes from being spontaneously combustible. This retarder is added in small amounts, relative to the oxidizing agent, and may be a bentonite clay "composed principally of aluminum silicates with some magnesium and iron". In addition, this patent uses a conventional starch binder.

Another relatively recent innovation relating to briquettes is disclosed in U.S. Pat. No. 3,836,343. According to this patent, the normal binding agents utilized in producing charcoal briquettes are pitch and bitumen and such binding agents generate large amounts of smoke. Accordingly, the object of the U.S. Pat. No. 3,836,343 is to produce a smokeless briquette. This is allegedly accomplished by replacing the known binding agents with a binding agent comprising a butadiene acrylonitrile copolymer. This copolymer is present in an amount of from 0.5% to 2%, by weight.

SUMMARY OF THE INVENTION

The present invention is based primarily on the surprising discovery that a relatively inexpensive readily available composition can be used to replace known binding agents to form a high-strength and readily-ignitable, charcoal briquette. The binding agent of the present invention is composed primarily of sodium or Wyoming bentonite which is a water hydratable clay which expands when in contact with water. Sodium bentonite must be distinguished from the other type of bentonites known as Southern or calcium bentonites which are not water hydratable. It is particularly surprising that sodium bentonite can be used in the binding agent of the present invention to produce a readily ignitable charcoal briquette in view of the U.S. Pat. No. 3,485,599 which discloses that a bentonite clay (which is unidentified) may be used as a retarding agent.

The binding agent of the present invention contains, as essential ingredients, sodium bentonite and a water soluble acid polymer (i.e. the polymer has one of the following substituents: carboxylic acid, a salt thereof, or an anhydride thereof). The mixture of sodium bentonite and the water soluble acid polymer appears to provide a synergistic effect in that the amount of sodium bentonite necessary to provide an adequate bind is appreciably reduced.

In addition to the sodium bentonite and water soluble acid polymer, the binder composition also preferably contains a water soluble dispersing agent such as the salts of phosphoric acid. The binder composition may also contain other additives such as oxidants, e.g. sodium nitrate, etc.

Accordingly, it is the primary object of the present invention to disclose and provide a combustible carbonaceous briquette, useful in barbecuing meat, which has high strength and readily combusts, said briquette containing combustible carbonaceous material and a binding agent composed of sodium bentonite and a water soluble acid polymer.

Another object of the present invention is to disclose and provide a method for producing a high strength and readily combustible briquette by forming a mixture of combustible carbonaceous material and a binding agent therefor, the binding agent being composed of sodium bentonite, a water soluble acid polymer and a water soluble dispersing agent.

Other objects of the present invention will be apparent from the following detailed description in which all parts and percentages are by weight unless specifically indicated otherwise.

DESCRIPTION OF THE PREFERRED EMBODIMENTS

As noted above, the primary constituent of the binding agent of the present invention is sodium bentonite. The preferred sodium bentonite of this invention is "yellow" sodium bentonite having a high surface area.

The amount of sodium bentonite in the binding agent composition of the present invention will be from about 80% to 99.9%, by weight, based on the entire weight of the binding agent composition, it being preferred that the amount of sodium bentonite in the binding agent composition is between about 90 or 95% and 99%.

A second essential ingredient of the binding agent composition of the present invention is a water soluble acid polymer. By acid polymer we mean a polymer having one or more of the following substituents thereon: a carboxylic acid group, a water soluble salt thereof or a carboxylic acid anhydride group. Exemplary of such water soluble acid polymers are polyacrylic acid, polymethacrylic acid (including copolymers of acrylic acid and methacrylic acid), hydrolyzed polyacrylamide, hydrolyzed polyacrylonitrile, and copolymers of maleic acid or maleic anhydride with acrylic acid, methacrylic acid, vinyl alcohol or vinyl acetate. In addition, water soluble salts of the foregoing are also useful in the present invention.

As is known in the art, salts of acrylic acid or methacrylic acid can be polymerized directly from the salts thereof to form the corresponding polyacrylate or polymethacrylate. If desired, the salt of either polymeric acid can be acidified to give polyacrylic acid or polymethacrylic acid. Also, as known in the art, hydrolyzed polyacrylamide and polyacrylonitrile wherein at least a portion of the nitrile groups (e.g. 40% to 95%) are converted to COOX where X is an anion such as —Na or —$NH_4$.

When using water soluble salts of any of the foregoing polymers it is generally preferred if alkali metals or alkaline earth metals are used and, specifically, it is most preferable to utilize either the sodium or potassium salt, for example, sodium polyacrylate or potassium polymethacrylate.

The presence of the water soluble acid polymers, including the salts thereof, to the binding agent composition increases the compressive strength significantly over the compressive strength achieved by only using sodium bentonite. It was this discovery that allowed the use of sodium bentonite as a binding agent for the combustible carbonaceous material and, particularly, charcoal.

The amount of the acid polymer of the present invention in the binding agent composition may range from 0.1% to 5%, by weight, based on the entire weight of the binding agent composition or additive. It is preferred if the amount of acid polymer, or water soluble salts thereof, are present in the binding agent additive in an amount ranging from about 0.2% to 2% or 3%, by weight.

A preferred ingredient of the binding agent of the present invention is a water soluble dispersing agent. Exemplary of water soluble dispersing agents which we have used to good effect are water soluble salts of phosphoric acid (phosphates) such as hypophosphate, orthophosphate, metaphosphate, and pyrophosphate. The particular cation forming the salt is unimportant providing that the resulting salt is water soluble. For example, the cation may be almost any metal salt such as an alkali metal or an alkaline earth metal. Exemplary of the alkali metal salts are sodium orthophosphate, tri-sodium orthophosphate, sodium metaphosphate and sodium acid pyrophosphate. Other alkali metals which are useful in producing phosphate salts are potassium and lithium, for example, potassium hydrophosphate, potassium pyrophosphate, and lithium phosphate. Exemplary of alkaline earth metal salts is monocalcium phosphate.

Other water soluble dispersants useful in the present invention are the water soluble salts of leonardite, leonardite being a natural occurring mineral which is sometimes considered a naturally oxidized lignite which contains humic acid. Other water soluble dispersants useful in the present invention are the water soluble salts of, for example, lignonsulfonic acid, humic acid, and fulvic acid.

The amount of water soluble dispersants present in the binding agent of the present invention can vary appreciably but, in general, the amount will range from 0.1% to 5%, by weight, and, preferably, from about 0.2% to 5%, by weight.

An optional ingredient, but one which is preferably present in the binder composition, is an oxidizing agent in order to render the resulting briquette more easily ignitable and one which will burn more rapidly. The oxidizing agent may be any number of compounds of a widely diverse nature, such compounds being well-known in the art. The preferred oxidizing agent is sodium nitrate and the oxidizing agent may be present in the additive composition in an amount of from 1% to 5%, by weight, based on the weight of the entire additive composition.

In making the combustible carbonaceous briquettes, the additive composition is added to the carbonaceous material, e.g. charcoal and intimately admixed therewith. Additionally, water is also added in order to make the mixture more workable and more easily formed into the briquette shape. The amount of binding agent composition added to the charcoal is not particularly critical and will vary from 1% to 10% and preferably 5% to 10%, by weight, based on the combined weight of the carbonaceous material and binding agent composition (i.e. excluding the moisture).

In the following examples charcoal is exemplified as the combustible carbonaceous material, however, other carbonaceous materials can also be used. In the following example, a charcoal briquette is made by taking charcoal (e.g. 100 parts by weight), and admixing therewith about 10 parts by weight of the following additive composition: 0.5%, by weight, of sodium polyacrylate; 1%, by weight, of sodium acid pyrophosphate; 2%, by weight, of sodium nitrate; and 96.5%, by weight, of sodium bentonite.

The charcoal and bentonite are mixed together and about 20 parts by weight of water is uniformly mixed with charcoal - binding agent additive mixture. The obtained wetted mixture is then pressed into the briquette form (commonly identified as a pillow briquette) on a briquetting machine, consisting of two rolls, each with an impression of half of the briquette on the roll. The two rolls are brought together under pressure and the charcoal mixture squeezed into the pockets to form the briquette.

After forming the charcoal into the briquette form they are placed into a dryer having a temperature of approximately 120° C. and are left in the dryer until substantially all of the moisture in the briquettes was removed (the final briquette having a moisture content of approximately 3%). After the briquettes are dried they are removed from the drier and allowed to cool to room temperature and then placed in packages for ultimate use by the consumer.

It was found that a briquette made as indicated above was approximately 50% stronger than a briquette made utilizing only sodium bentonite as the binding agent.

In the following examples charcoal briquettes are made as indicated above, the binder having the following composition: 1.5%, by weight, of sodium acid pyrophosphate; 0.5%, by weight, sodium polyacrylate; and 98.5%, by weight, of sodium bentonite.

This binder composition was added, in varying amounts, to charcoal as indicated in the following Table I, in which green strength was measured in arbitrary units for comparison purposes.

GREEN AND COMPRESSIVE STRENGTHS

| | % Binder | Green Strength | Dry Compressive Strength (psi) |
|---|---|---|---|
| Binder A | 6 | 13.4 | 53.5 |
| Binder A | 8 | 21.3 | 64.5 |
| Sodium Bentonite | 6 | 5.1 | 9.3 |
| Sodium Bentonite | 7 | 8.0 | 17.8 |
| Sodium Bentonite | 8 | 8.8 | 23.9 |
| Sodium Bentonite | 12 | 11.3 | 52.9 |
| Charcoal | 0 | 4.0 | 5.0 |

Although in the foregoing examples, a specific oxidizing agent was used, a specific salt of phosphoric acid was used, and a specific acrylic polymer was used, it is understood that other acid polymers, other salts of phosphoric acid, and other oxidizing agents can be utilized with equally good effect. For example, a sodium polymethacrylate could be used in lieu of the sodium polyacrylate. Additionally, potassium metaphosphate, etc. can also be used in place of the sodium acid pyrophosphate, it being understood that the foregoing preferred exemplary embodiments are merely illustrative of the present invention and are not to be considered to be limiting.

We claim:

1. A combustible carbonaceous briquette having a high bond strength and good burning characteristics, consisting essentially of a combustible carbonaceous material and a bonding agent composition therefor, the bonding agent composition consisting essentially of from about 80% to 99.9%, by weight, of sodium bentonite and from about 0.1% to 5%, by weight, of a water soluble acid polymer; the amount of combustible carbonaceous material being from about 90% to 99%, by weight, based on the combined weight of the combustible carbonaceous material and binding agent composition, and the amount of binding agent composition being from 1% to 10%, by weight, based on the combined weight of the combustible carbonaceous material and binding composition.

2. A combustible carbonaceous briquette according to claim 1 wherein the combustible carbonaceous material is charcoal.

3. A combustible carbonaceous briquette according to claim 2 wherein the binding agent composition also contains from 0.1% to 5%, by weight, of a water soluble dispersing agent.

4. A combustible carbonaceous briquette according to claim 3 wherein the water soluble acid polymer is a member selected from the group consisting of polyacrylic acid, polymethacrylic acid, the water soluble salt of polyacrylic acid, the water soluble salt of polymethacrylic acid, hydrolyzed polyacrylamide, hydrolyzed polyacrylonitrile, and copolymers of maleic acid or maleic anhydrides with acrylic acid, methacrylic acid, vinyl alcohol or vinyl acetate.

5. A combustible carbonaceous briquette according to claim 3 wherein the water soluble dispersing agent is a member selected from the group consisting of the water soluble salt of phosphoric acid, the water soluble salt of leonardite, water soluble salt of lignonsulfonic acid, water soluble salt of humic acid, and the water soluble salt of fulvic acid.

6. A combustible carbonaceous briquette according to claim 3 wherein the water soluble dispersing agent is the water soluble salt of phosphoric acid and the water soluble acid polymer is a member selected from the group consisting of polyacrylic acid, polymethacrylic acid, copolymers thereof, and the water soluble salts thereof.

7. A combustible carbonaceous briquette according to claim 3 wherein the binding agent composition contains an oxidizing agent.

8. A combustible carbonaceous briquette according to claim 7 wherein the oxidizing agent is sodium nitrate.

* * * * *